United States Patent [19]

Hoff

[11] Patent Number: 4,866,973

[45] Date of Patent: Sep. 19, 1989

[54] PIVOTABLE MOUNTING BASE FOR A COLLET CRIMPING MACHINE

[75] Inventor: Steven R. Hoff, New Haven, Ind.

[73] Assignee: Dana Corporation, Toledo, Ohio

[21] Appl. No.: 221,060

[22] Filed: Jul. 19, 1988

[51] Int. Cl.[4] ..... B21D 41/04

[52] U.S. Cl. ..... 72/402; 72/447; 29/237

[58] Field of Search ..... 72/402, 462, 482, 481, 72/447; 29/237, 283.5, 753, 761

[56] References Cited

U.S. PATENT DOCUMENTS

| | | | |
|---|---|---|---|
| 2,141,657 | 12/1938 | Meier | 72/447 |
| 3,731,518 | 5/1973 | Blochner | 72/402 |
| 3,750,452 | 8/1973 | Frank | 72/402 |
| 4,250,607 | 2/1981 | Lillbacka et al. | 72/402 |
| 4,285,228 | 8/1981 | Gunning | 72/402 |
| 4,309,892 | 1/1982 | Currie | 29/237 |
| 4,434,978 | 3/1984 | Kloster | 269/69 |
| 4,485,664 | 12/1984 | Richards | 72/389 |
| 4,625,539 | 12/1986 | Brooks et al. | 72/402 |

FOREIGN PATENT DOCUMENTS

| | | | |
|---|---|---|---|
| 363919 | 4/1921 | Fed. Rep. of Germany | 72/447 |
| 2434683 | 2/1975 | Fed. Rep. of Germany | 72/402 |
| 142012 | 6/1980 | German Democratic Rep. | 29/237 |

*Primary Examiner*—Daniel C. Crane

*Attorney, Agent, or Firm*—MacMillan, Sobanski & Todd

[57] ABSTRACT

A mounting structure for a collet crimping machine is disclosed which permits the machine to be selectively pivoted from between vertical and horizontal positions as desired for use. A pivotable mounting bracket includes a flat base plate having a pair of upstanding brackets secured thereto. An arm is pivotably connected to each of the brackets. The ends of the arms are connected to the bottom of the collet crimping machine, permitting the machine to be pivoted between vertical and horizontal positions. A piston and cylinder assembly may be connected between the base plate and the collet crimping machine. The piston and cylinder assembly may function similar to a shock absorber, so as to cushion the movement of the machine as it is pivoted. Alternatively, the piston and cylinder assembly may be connected to a source of pressurized fluid so as to selectively move the machine between the vertical and horizontal positions.

20 Claims, 2 Drawing Sheets

PIVOTABLE MOUNTING BASE FOR A COLLET CRIMPING MACHINE

BACKGROUND OF THE INVENTION

The present invention relates in general to collet crimping machines and in particular to a pivotable mounting base for a collet crimping machine which permits the machine to be selectively moved between horizontal and vertical positions.

The collet crimping machine is a well known device which is principally used for attaching a tubular end portion of a metallic fitting to the end of a high pressure hydraulic hose. To accomplish this, the end portion of the fitting is initially formed having an inner diameter which is larger than the outer diameter of the hose, permitting the end of the hose to be loosely inserted therein. Then, the end of the hose and the fitting are inserted within a die assembly of the collet crimping machine. The die assembly includes a collet which is contracted, by means of a hydraulically actuated mechanism on the collet crimping machine, so as to permanently deform or crimp the tubular end portion of the fitting about the end of the hose.

In the past, collet crimping machines have been fixedly mounted for use in a generally vertical position. When mounted in such a position, the end of the hose and the fitting are inserted vertically upwardly through the bottom of the machine to position them within the die assembly for the crimping operation. The vertical orientation of the machine facilitates the insertion and removal of different die assemblies from the machine, as is often necessary for crimping different sizes and shapes of fittings and hoses, by making them easily reachable by an operator of the machine. Additionally, the force of gravity tends to maintain the components of the die assembly in a desired orientation for use.

Unfortunately, a vertically oriented collet crimping machine may be difficult to use when attempting to attach a fitting onto the end of a long length of relatively inflexible hose. If the length of the hose is greater than the distance separating the bottom of the machine from the floor upon which it is used, an inflexible hose will resist being bent to permit the vertical insertion described above within the machine. To solve this problem, collet crimping machines have been fixedly mounted for use in a generally horizontal position. In such machines, the end of the hose and the fitting are inserted horizontally through the bottom of the machine to position them for the crimping operation. Although such machines are readily usable with hoses of virtually any length, it is awkward for the operator of the machine to insert and remove different die assemblies from the machine. Also, the individual components of the die assembly can be misaligned from their desired orientation because the force of gravity does not tend to maintain them in that orientation.

SUMMARY OF THE INVENTION

The present invention provides a novel mounting structure for a collet crimping machine which permits the machine to be selectively pivoted from between vertical and horizontal positions as desired for use. A pivotable mounting bracket is provided including a flat base plate having a pair of upstanding brackets secured thereto. An arm is pivotably connected to each of the brackets. The ends of the arms are connected to the bottom of the collet crimping machine. Consequently, the machine may be pivoted between vertical and horizontal positions. If desired, a piston and cylinder assembly may be connected between the base plate and the collet crimping machine. The piston and cylinder assembly may function similar to a shock absorber, so as to cushion the movement of the machine as it is pivoted. Alternatively, the piston and cylinder assembly may be connected to a source of pressurized fluid so as to selectively move the machine between the vertical and horizontal positions.

It is an object of the present invention to provide a pivotable mounting base for a collet crimping machine which permits the machine to be selectively moved between horizontal and vertical positions.

It is another object of the present invention to provide such a pivotable mounting base for a collet crimping machine which is simple and inexpensive in construction and operation.

Other objects and advantages of the present invention will become apparent to those skilled in the art from the following detailed description of the preferred embodiments, when read in light of the accompanying drawings.

DETAILED DESCRIPTION OF THE PREFERRED EMBODIMENTS

Figure 1:
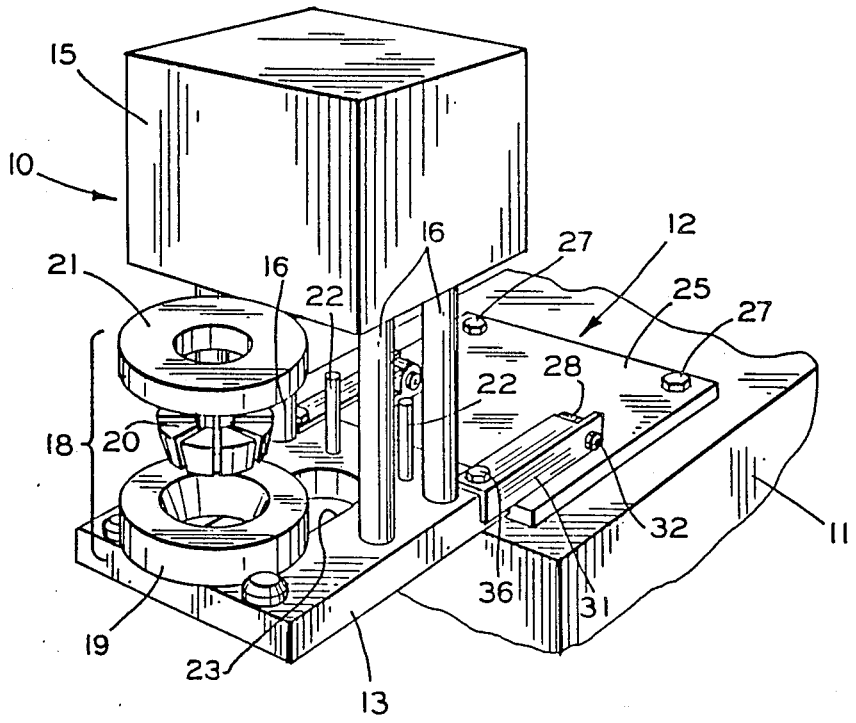
FIG. 1 is a front perspective view of a collet crimping machine mounted on a pivotable base in accordance with the present invention, the collet crimping machine being disposed in the vertical position.

Referring now to the drawings, there is illustrated in FIG. 1 a collet crimping machine, indicated generally at 10, mounted on a support surface 11 by means of a pivotable mounting base, indicated generally at 12. The collet crimping machine 10 is conventional in the art and, for example, may be formed having the structure described and illustrated in U.S. Pat. No. 3,750,452, owned by the assignee of the present invention. The disclosure of that patent is incorporated herein by reference. Briefly, however, the collet crimping machine 10 includes a lower bed frame plate 13, an upper frame housing 15, and a set of columns 16. The columns 16 support the upper frame housing 15 above the bed frame plate 13. A ram 17 (FIGS. 3 and 4) is reciprocably carried by the upper frame housing 15 for selective movement toward and away from the bed frame plate 13.

A die assembly 18, including a die ring 19, a collet assembly 20, and a spacer ring 21, are adapted to be disposed between the bed frame plate 13 and the upper frame housing 15. A pair of stop pins 22 are connected to the rear portion of the bed frame plate 13 and extend upwardly therefrom. The stop pins 22 provide a positive locating means for positioning the die assembly 18 beneath the ram 17. As is well known in the art, when the die assembly 18 is properly positioned within the collet crimping machine 10, an end of a hose having a tubular metallic fitting (neither shown) may be inserted therein through a slot 23 formed through the bed frame plate 13. The ram 17 is then actuated to move downwardly into engagement with the die assembly so as to cause the collet assembly 20 to crimp the fitting onto the end of the hose.

Figure 2:
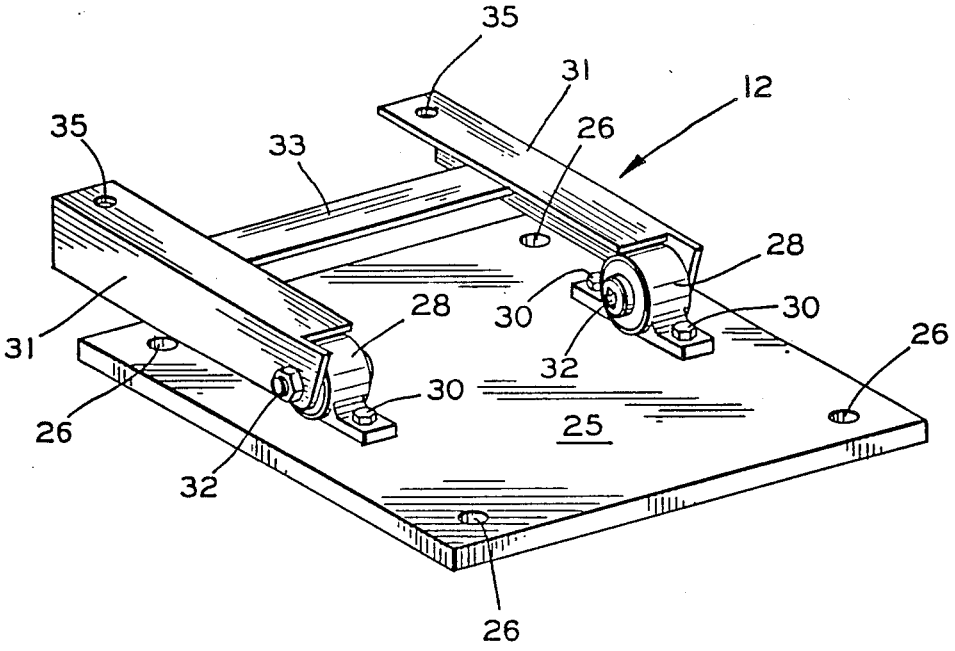
FIG. 2 is a rear perspective view of the pivotable mounting base,shown in FIG. 1.

The structure of the pivotable mounting base 12 is more clearly illustrated in FIG. 2. As shown therein, the mounting base 12 includes a base plate 25 having a plurality of apertures 26 formed therethrough. The apertures 26 permit respective threaded fasteners 27 to extend therethrough so as to secure the base 25 to the support surface 11. A pair of upstanding brackets 28 are secured to the upper face of the base 25 by means of threaded fasteners 30. Each of the brackets 28 has a transverse aperture (not shown) formed therethrough for a purpose which will be explained below. The apertures formed through the brackets 28 are aligned with one another so as to be co-axial.

Figure 3:
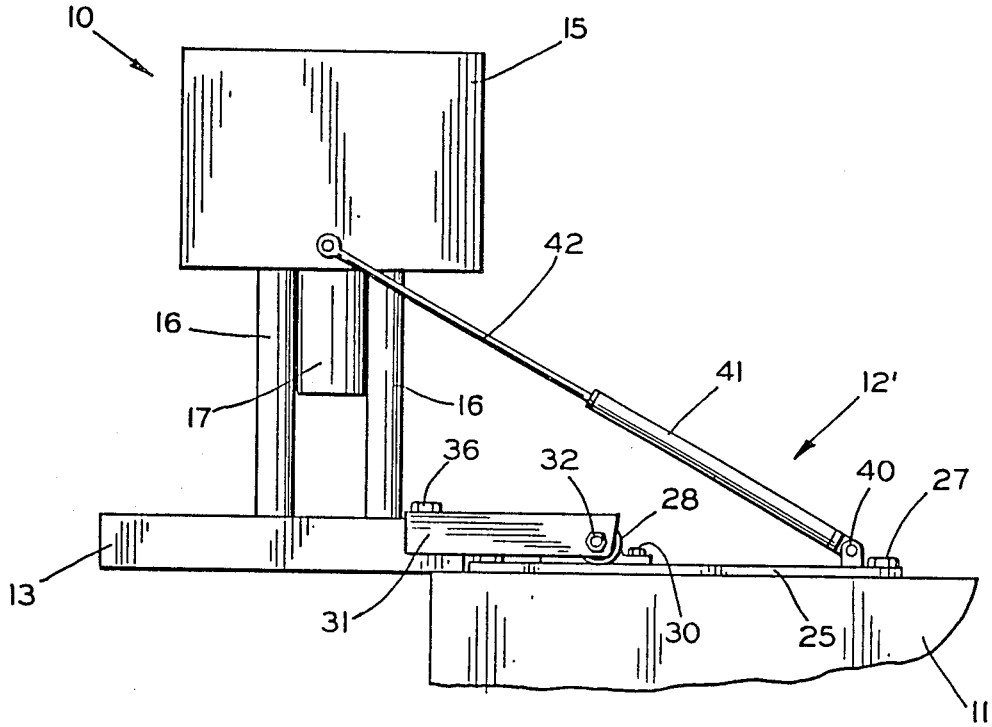
FIG. 3 is a side elevational view of a collet crimping machine mounted on a second embodiment of the pivotable mounting base, the collet crimping machine being disposed in the vertical position.
Figure 4:
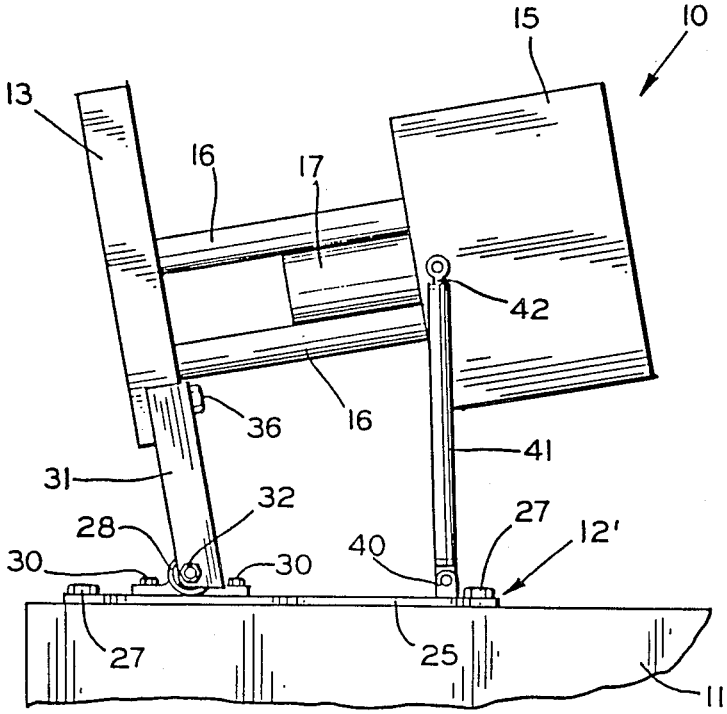
FIG. 4 is a side elevational view of the second embodiment of the pivotable mounting base showing the collet crimping machine disposed in the horizontal position.

The mounting base 12 further includes a pair of arms 31, each of which is pivotably connected to a respective one of the brackets 28. Each of the arms 31 is formed from an L-shaped piece of relatively stiff metal, having an upper portion (which extends parallel to the base plate 25 when the arm 31 is oriented as shown in FIGS. 1 through 3) and a side portion (which extends perpendicular to the base plate 25). A first end of each of the arms 31 has an aperture (not shown) formed through the side portion thereof. Pivot pins 32 extend respectively through the apertures formed through the side portions of the arms 31 and through the corresponding apertures formed in the brackets 28 to pivotably connect the first ends of the arms 31 to the brackets 28. As a result, the arms 31 are permitted to pivot between a first position, as shown in FIGS. 1, 2, and 3, to a second position, as shown in FIG. 4. If desired, a cross member 33 (FIG. 2) may be connected between the two arms 31 so that the arms 31 pivot together as a single unit. The cross member 33 can be secured to the arms 31 by any conventional means, such as by welding or threaded fasteners (not shown).

Adjacent to a second end of each of the arms 31, an aperture 35 is formed through the upper portion thereof. The apertures 35 permit respective threaded fasteners 36 (FIGS. 1, 3, and 4) to extend therethrough into engagement with the bed frame plate 13. When so engaged, the bed frame plate 13 is connected to the arms 31 for movement therewith. Consequently, the collet crimping machine 10 is mounted on the base plate 25 for pivotable movement relative to the support surface 11. As best shown in FIGS. 3 and 4, the pivotable mounting base 12 permits the collet crimping machine 10 be selectively moved between a generally vertical position (FIG. 3) to a generally horizontal position (FIG. 4).

To use the collet crimping machine 10, the machine 10 is initially moved to the vertical orientation illustrated in FIGS. 1 and 3. A desired die assembly 18, corresponding to a predetermined size of hose and fitting to be secured together, is selected from a plurality of such die assemblies. As best shown in FIG. 1, the selected die assembly 18 can be easily inserted within the collet crimping machine 10 by an operator of the machine 10 when it is oriented in the vertical position. Because the individual components 19, 20, and 21 of the die assembly 18 are arranged in a stacked fashion, the force of gravity tends to maintain such components 19, 20, and 21 in that arrangement.

Once the selected die assembly 18 has been inserted in this manner, the collet crimping machine 10 is then pivoted to the horizontal position illustrated in FIG. 4. Means may be provided to limit the amount of such pivoting movement so that the collet crimping machine 10 does not pivot a full ninety degrees from the vertical disposition. Rather, the collet crimping machine 10 is preferably maintained in a slightly tilted position (ten degrees, for example) above the horizontal plane defined by the base plate 25. In the illustrated embodiment, the upper portions of the first ends of the arms 31 are cut back or recessed a short distance from the corresponding side portions thereof. When the machine 10 is pivoted to the horizontal position, such upper portions abut the upper surfaces of the brackets 28 to limit the pivoting movement of the machine 10.

When the machine 10 is pivoted to the horizontal position, the force of gravity causes the die assembly 18 to slide rearwardly along the bed frame plate 13 until it abuts the two stop pins 22. Such abutment properly positions the die assembly 18 relative to the ram 17 for use. Since the machine 10 remains slightly tilted in the horizontal position, the individual components 19, 20, and 21 of the die assembly 18 tend to remain properly aligned relative to one another against the stop pins 22. This is because a component of the force of gravity is directed axially downwardly through through the die assembly 18. If the machine 10 was tilted further to the full horizontal position, the force of gravity would actually tend to separate such components 19, 20, and 21 from one another because of the tapered surfaces of the die ring 19 and the collet assembly 20.

In this horizontal position, an end of a hose having a loose tubular metallic fitting may be inserted within the machine 10 through the slot 23 formed through the bed frame plate 13. It can be seen that such insertion can be readily accomplished regardless of the length of the hose. After crimping a number of fittings onto hoses of a particular size, the collet crimping machine 10 can be quickly adapted for use on other sizes by pivoting it back to the vertical position illustrated in FIG. 1. In this position, the die assembly 18 can be quickly and easily removed by the operator to permit the insertion of a different die assembly. Once the new die assembly has been inserted, the machine 10 may be pivoted back to the horizontal position for use. Alternatively, the machine 10 may be used in the vertical position if desired.

In FIGS. 3 and 4, a second embodiment of the mounting base 12' is illustrated. The mounting base 12' is identical to the mounting base 12 described above, but further includes an upstanding cylinder bracket 40 secured to the upper face of the base plate 25. A hollow cylinder 41 is pivotably connected to the cylinder bracket 40. A first end of a piston 42 is disposed within the cylinder 41 for telescopic movement, while a second end of the piston 42 is pivotably connected to the upper frame housing 15. The cylinder 41 and piston 42 are conventional in the art and may function in the nature of the shock absorber. In other words, rapid movement of the piston 42 relative to the cylinder 41 is resisted by internal fluid pressure, friction, or other means. Consequently, when the machine 10 is pivoted from one position to the other, the cylinder 41 and the piston 42 resist such movement. This resistance prevents the machine 10 from flopping downwardly under its own weight into either of the positions when the center of gravity thereof passes over the pivot point defined by the pivot pins 32.

The collet crimping machine 10 may be moved between the two positions by manually pushing or pulling it in the desired direction. Alternatively, the cylinder 41 and the piston 42 may provide a means for moving the machine 10 between the two positions. By connecting the cylinder 41 to a conventional source of pressurized hydraulic fluid (not shown), the force generated by such pressurized fluid against the piston 42 can be used to pivot the machine 10, as opposed to the manual force exerted by the operator. A simple control circuit (now shown) may be used in conjunction with the source of hydraulic fluid so as to control which direction the machine 10 is pivoted.

In accordance with the provisions of the patent statutes, the principle and mode of operation of the present invention have been explained and illustrated in its preferred embodiments. However, it must be understood that the present invention may be practiced otherwise than as specifically explained and illustrated without departing from its spirit or scope.

What is claimed is:

1. An apparatus for crimping a tubular metallic fitting onto the end of a hose comprising:

a collet crimping machine including a lower frame plate, a die assembly carried on said lower frame plate, and means supported on said lower frame plate for selectively engaging said die assembly so as to crimp a tubular metallic fitting onto the end of a hose; and means for pivotably mounting said collet crimping machine on a support surface such that said collet crimping machine may be moved between first and second positions, said pivotable mounting means including a pair of upstanding brackets securable to the support surface and a pair of arm means, said arm means having first ends respectively connected to said brackets and second ends connected to said collet crimping machine.

2. The invention defined in claim 1 further including a cross member attached to each of said arm means so that said arm means pivot together as single unit.

3. The invention defined in claim 1 wherein said collet crimping machine is pivotably movable between a vertical position and a horizontal position.

4. The invention defined in claim 1 wherein said collet crimping machine is pivotably movable between a vertical position and generally horizontal position which is less than ninety degrees from said vertical position.

5. The invention defined in claim 1 further including means for resisting movement of said collet crimping machine between said first and second positions.

6. The invention defined in claim 5 wherein said means for resisting includes a cylinder pivotably connected to said means for pivotably mounting and a piston, said piston having a first end disposed within said cylinder for telescopic movement and a second end pivotably connected to said collet crimping machine.

7. The invention defined in claim 1 further including means for pivoting said collet crimping machine between said first and second positions.

8. The invention defined in claim 7 wherein said means for pivoting includes a cylinder pivotably connected to said means for pivotably mounting and a piston, said piston having a first end disposed within said cylinder for telescopic movement and a second end pivotably connected to said collet crimping machine.

9. The invention defined in claim 1 wherein each of said arm means includes a pivot pin pivotably mounted in said bracket.

10. The invention defined in claim 9 wherein each of said arm means further includes an arm connected between said pivot pin and said collet crimping machine.

11. An apparatus for crimping a tubular metallic fitting onto the end of a hose comprising:

a collet crimping machine including a lower bed frame plate, an upper frame housing, a set of columns supporting said upper frame housing above said bed frame plate, a ram reciprocably carried by said upper frame housing for selective movement toward and away from said bed frame plate, and a die assembly disposed between said lower bed frame plate and said upper frame housing selectively engaged by said ram for crimping a tubular metallic fitting onto the end of a hose; and means for pivotably mounting said collet crimping machine on a support surface such that said collet crimping machine may be moved between first and second positions, said pivotable mounting means including a pair of upstanding brackets securable to the support surface and a pair of arm means, said arm means having first ends respectively connected to said brackets and second ends connected to said collet crimping machine.

12. The invention defined claim 11 further including a cross member attached to each of said arm means so that said arm means pivot together as single unit.

13. The invention defined in claim 11 wherein said collet crimping machine is pivotably movable between a vertical position and a horizontal position.

14. The invention defined in claim 11 wherein said collet crimping machine is pivotably movable between a vertical position and a generally horizontal position which is less than ninety degrees from said vertical position.

15. The invention defined in claim 11 further including means for resisting movement of said collet crimping machine between said first and second positions.

16. The invention defined in claim 15 wherein said means for resisting includes a cylinder pivotably connected to said means for pivotably mounting and a piston, said piston having a first end disposed within said cylinder for telescopic movement and a second end pivotably connected to said collet crimping machine.

17. The invention defined in claim 11 further including means for pivoting said collet crimping machine between said first and second positions.

18. The invention defined in claim 17 wherein said means for pivoting includes a cylinder pivotably connected to said means for pivotably mounting and a piston, said piston having a first end disposed within said cylinder for telescopic movement and a second end pivotably connected to said collet crimping machine.

19. The invention defined in claim 11 wherein each of said arm means includes a pivot pin pivotably mounted in said bracket.

20. The invention defined in claim 19 wherein each of said arm means further includes an arm connected between said pivot pin and said collet crimping machine.

* * * * *